US006651753B2

(12) United States Patent
Gauthier

(10) Patent No.: US 6,651,753 B2
(45) Date of Patent: Nov. 25, 2003

(54) EARTH LEVELING EXCAVATOR

(76) Inventor: George R. Gauthier, 113 Interlude Rd., New Iberia, LA (US) 70563

( * ) Notice: Subject to any disclaimer, the term of this patent is extended or adjusted under 35 U.S.C. 154(b) by 90 days.

(21) Appl. No.: 09/844,136

(22) Filed: Apr. 27, 2001

(65) Prior Publication Data

US 2002/0166266 A1 Nov. 14, 2002

(51) Int. Cl.[7] ..... A01B 33/06
(52) U.S. Cl. ..... 172/111; 172/523
(58) Field of Search ..... 172/522–524, 172/59, 111, 230, 228; 30/371–379.5, 388–391, 263, 264, 276, 277.4, 272.1, 286–298.4, 347, 355, 357

(56) References Cited

U.S. PATENT DOCUMENTS 1,370,774 A * 3/1921 Abernathy
2,581,642 A * 1/1952 Forney
3,006,423 A * 10/1961 Buddingh et al. ..... 172/523
3,593,802 A * 7/1971 De Lange, Jr. ..... 172/111 X

* cited by examiner

*Primary Examiner*—Christopher J. Novosad
(74) *Attorney, Agent, or Firm*—Kirby J. Hebert

(57) ABSTRACT

An excavating apparatus having a rotating cutting head for precision removal of soil, for site preparation prior to construction projects where level grade is required. The powered cutting head is mounted on a longitudinal frame, with travel of the cutting head guided along the length of the frame. Adjustable positioning is provided to maintain position of the cutting head longitudinally along the frame. The frame is pivotally anchored to the ground at one end and is supported by wheels at the other end. Wheels are positioned to facilitate rotation of the frame and cutting head around the anchoring pivot, which is located at the center of the area to be excavated. The elevation of the frame is adjustable to selectively raise and lower the depth of the cutting head. The apparatus is easily transported and has the ability to perform precision excavating operations in confined areas.

2 Claims, 4 Drawing Sheets

EARTH LEVELING EXCAVATOR

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

This invention relates to an excavating apparatus for leveling earth by excavation to level grade for the installation of above ground swimming pools or any construction practice requiring precision grade leveling in small, and/or, enclosed areas.

Powered excavating equipment is currently marketed which perform a variety of excavating and leveling operations. Excavators include equipment that will remove earth in a controlled manner. Grade leveling equipment is often used in the preparation of roadbeds, building construction sites and other construction and agricultural operations. Currently available apparatus are best suited to large areas or operations that do not require a high degree of precision. Available apparatus often require large work sites in which to operate and these apparatus also often impact large areas surrounding the work site. Because of these problems, excavation in small, confined areas have typically been performed by labor intensive methods employing shovels and other hand held tools.

BRIEF SUMMARY OF THE INVENTION

The present invention is an excavating apparatus having a rotating cutting head for precision removal of soil to obtain level grade. The powered cutting head is mounted on an assembly including the cutting head, an engine and power transmission system. The cutting head assembly is positionable linearly along a longitudinal frame, with travel of the cutting head guided by the operator. The depth of excavation is adjustable, as is the positioning of the cutting head. The frame is pivotally anchored to the ground at one end and is supported by wheels at the other end. The effective length of the frame is made adjustable by positioning of the ground-anchoring pivot along the frame, thereby allowing the operator to adjust the area to be excavated. Wheels are provided to facilitate rotation of the frame and cutting head around the anchoring pivot, which is located at the center of the area to be excavated. The depth of excavation is also adjustable and the apparatus is easily transported.

The present apparatus is directed toward precision earth leveling in small, confined areas, where access by typical grade leveling equipment would be limited. The relative small size and easy portability of the present apparatus also provides a cost efficient and convenient alternative to manual labor intensive means for any small precision earth leveling operation, even when confined space is not a concern. The present apparatus is also able to excavate earth to a consistent precision sloping grade without modification.

One object of the invention is to provide a device that reduces the impact of the excavating operation on the area surrounding the work site and reduces the required area around the work site. It is another object of the invention to provide a mechanized means for precision leveling of earth for small construction projects and in confined areas. Further objects and advantages of the invention will become apparent from a consideration of the drawings and ensuing description.

DETAILED DESCRIPTION OF THE INVENTION

Figure 1:
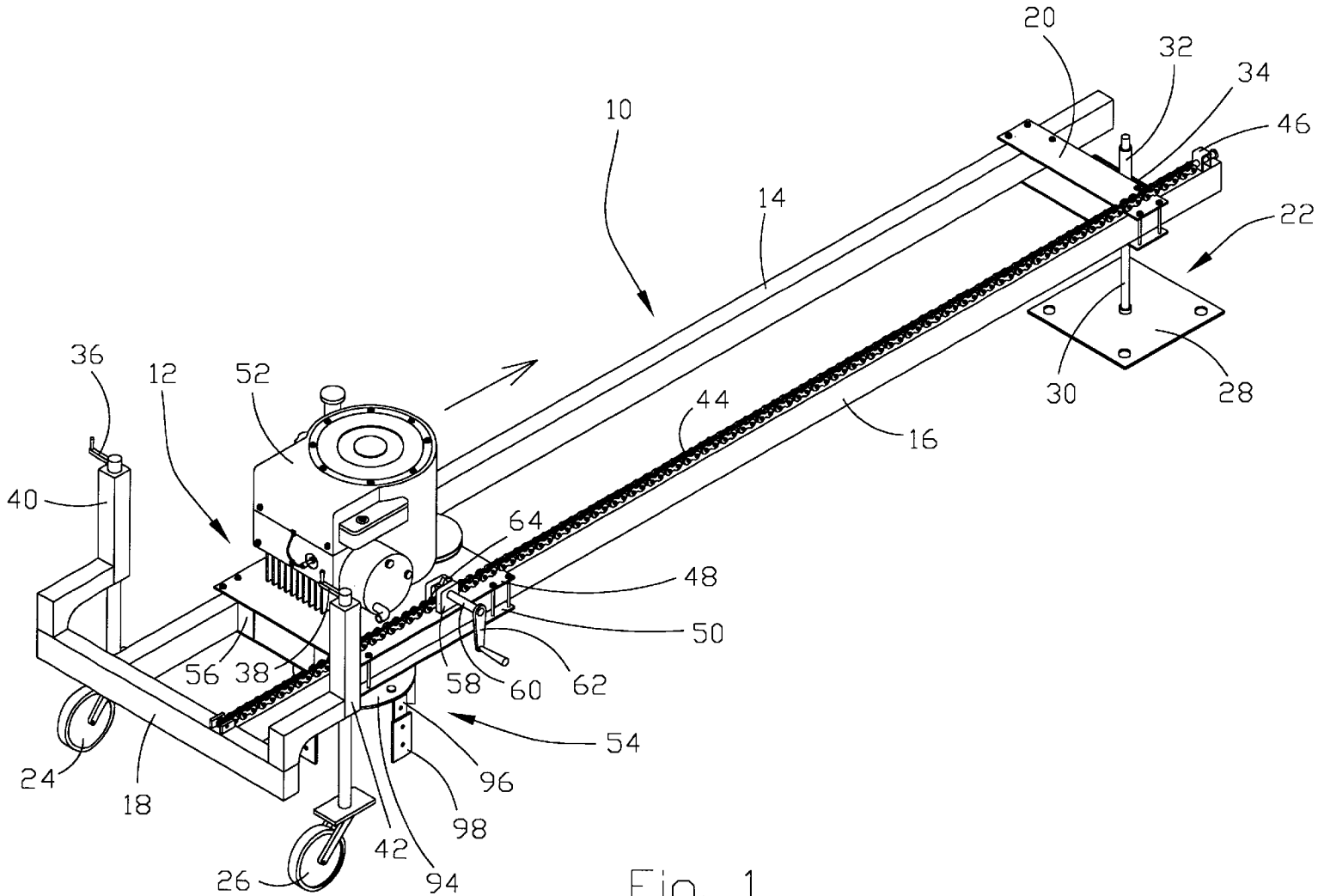
FIG. 1 is a perspective view of the earth-leveling excavator embodying the present invention.

The example embodiment of the present apparatus shown in FIG. 1 consists of a longitudinal main chassis or support frame 10, on which is mounted a movable and positionable cutter head and engine mounting assembly 12.

The main chassis 10 consist of two parallel longitudinal rails 14 and 16 connected at one end by a fixed cross member 18. A positionable cross member 20 is attached at the other end of the main chassis 10. A ground engaging anchor 22 is pivotally attached to the positionable cross member 20 and the opposite end of the main chassis 10 is supported by two free swiveling wheels 24 and 26 attached to the fixed cross member 18, for free pivotal movement of the main chassis 10 around the anchor 22. The ground-engaging anchor 22 consist of a base plate 28 and a shaft 30. The shaft 30 is positioned through a bushing 32 that is secured to the positionable cross member 20 by a bracket 34. Hand cranks 36 and 38 are attached to jack assemblies 40 and 42 that are attached to wheels 24 and 26 for height adjustment and leveling of the main chassis 10. A roller chain 44 is attached to longitudinal rail 16. The roller chain 44 is secured at each end of longitudinal rail 16 and pulled taut along the top of longitudinal rail 16 by a chain tensioner 46.

Figure 2:
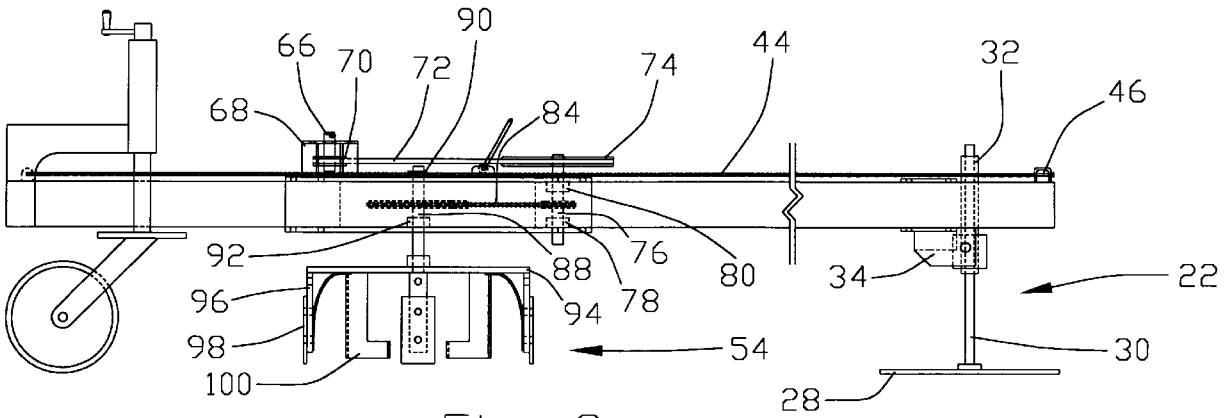
FIG. 2 is an enlarged and broken side elevation including the frame, cutting head, wheels and anchoring pivot.
Figure 3:
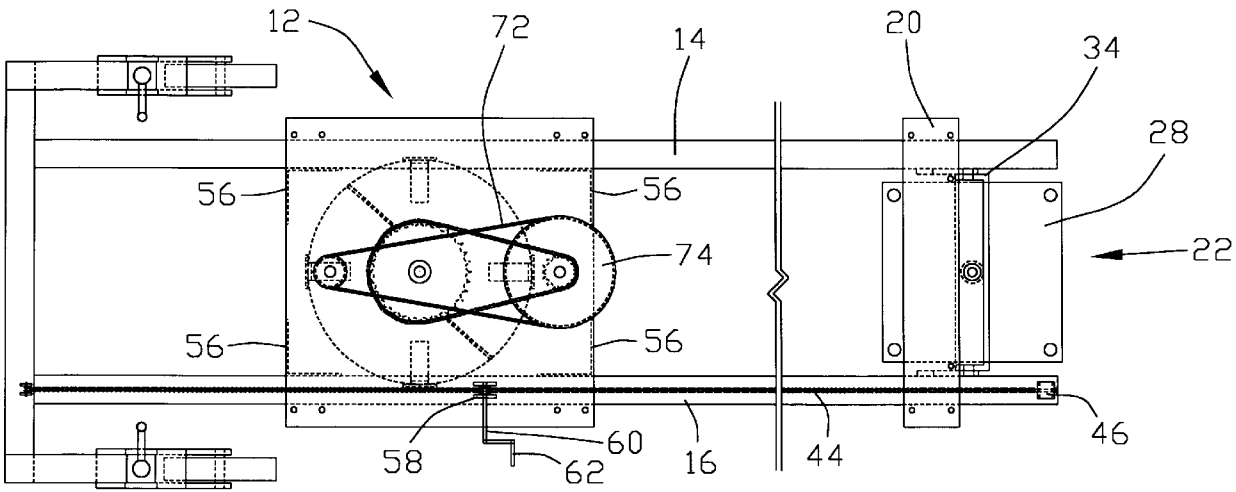
FIG. 3 is an enlarged and broken top view including the frame, engine and cutting head support frame, wheels and anchoring pivot.

The movable and positionable mounting assembly 12 consists of a top plate 48 and bottom plate 50 for supporting an internal combustion engine 52 and a cutter head 54. A set of four rail guides 56 are attached to mounting plates 48 and 50 to allow for guided linear movement of the positionable mounting assembly 12 along the longitudinal rails 14 and 16. A bushing 58 is attached to the top mounting plate 48. The bushing supports a horizontal shaft 60 that is attached to a hand crank 62 and sprocket 64. The sprocket 64 engages the roller chain 44 for movement and positioning of the mounting plate assembly 12 along the longitudinal rails 14 and 16. FIGS. 2 and 3 further detail the ground-engaging anchor 22, the movable and positionable cutter head and engine mounting assembly 12, and the cutter head 54.

Figure 4:
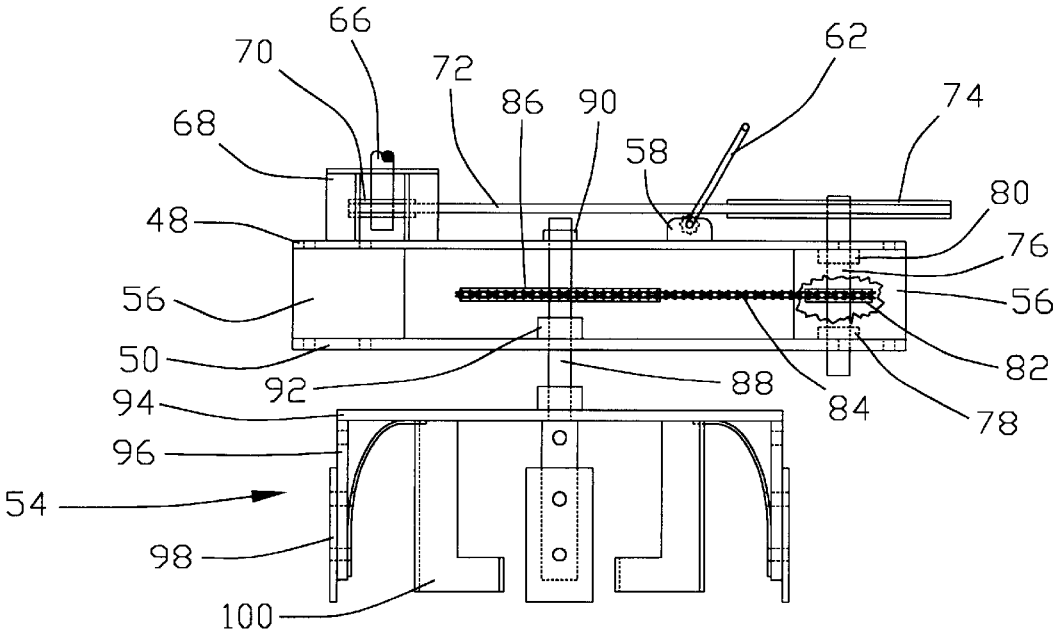
FIG. 4 is an enlarged side elevation showing the cutting head, engine and cutting head support frame, cutting head power transmission components and longitudinal positioning hand crank.
Figure 5:
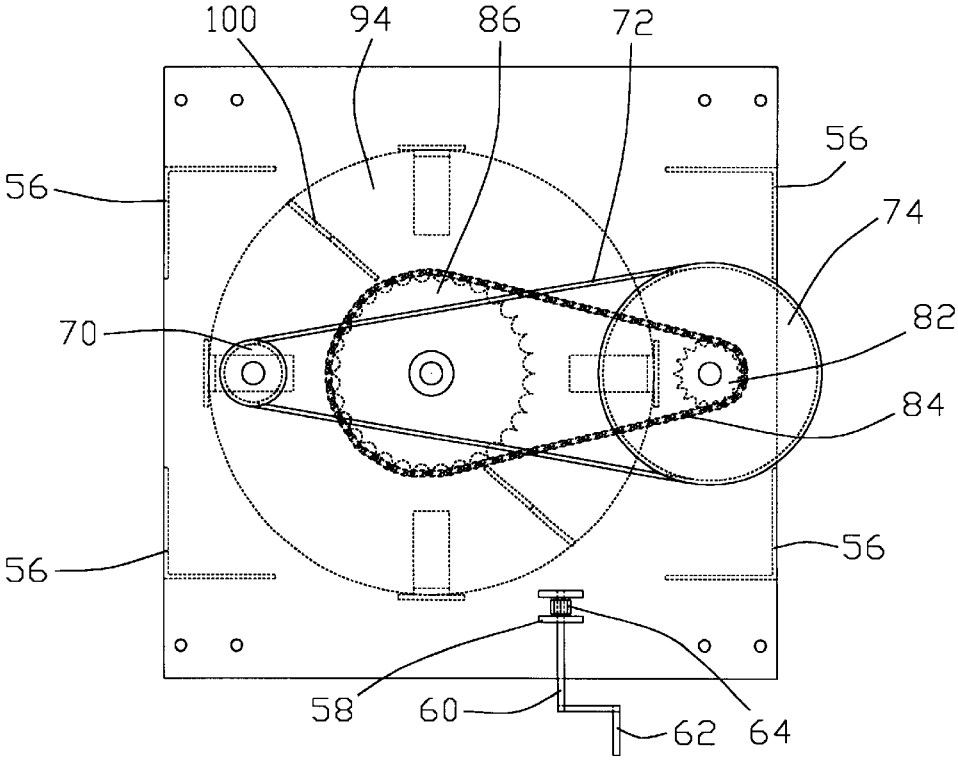
FIG. 5 is an enlarged top view showing the engine and cutting head support frame, cutting head power transmission components and longitudinal positioning hand crank.

FIGS. 4 and 5 show a vertical output shaft 66 that is turned by the engine (shown in FIG. 1) and is supported by a bearing and bracket assembly 68 that is attached to the top mounting plate 48. The shaft is attached to and turns a pulley 70. The pulley drives a belt 72, which turns a larger pulley 74 for torque increase. The larger pulley 74 is attached to and turns a vertical shaft 76, which is supported by bearings 78 and 80. The shaft 76 is attached to and turns sprocket 82, which drives a roller chain 84. The roller chain 84 turns a larger sprocket 86 for further torque increase. The larger sprocket 86 is attached to and turns a vertical shaft 88. The shaft 88 is supported by bearings 90 and 92 and is attached to the excavating cutter head 54. The cutter head consists of a circular disk 94 that is attached to the shaft 88. Four blade holders 96 are attached to and extend downward from the disk 94. Cutting blades 98 are mounted to the blades holders 96. Two soil thrower plates 100 are mounted vertically and radially on the underside of the disk 94 for clearing away of loose soil cuttings.

Level earth excavation is accomplished with the apparatus by first adjusting the positionable cross member 20 to a position along the longitudinal rails 14 and 16 appropriate for the area to be excavated, best illustrated in FIG. 1. The distance from the wheeled end of the main chassis 10 and the position of the movable cross member 20 determines the radius of a circular work area. The anchor base plate 28 is then secured to the ground at the center of the desired work area with weights or by staking. The base plate 28 is secured at an elevation that will determine the depth of cut for the rest of the work area. The mounting assembly 12 is brought to the fixed cross member 18 end of the main chassis 10 and the engine is started. By turning hand cranks 36 and 38 the cutting head 54 is lowered into the earth to the desired depth and the main chassis 10 is leveled. An external leveling device such as a transit or laser level is used to level the main chassis 10. The operator then pushes the wheeled end of the main chassis 10 in a circle around the ground-engaging anchor 22 while turning hand cranks 36 and 38 in order to maintain the level attitude of the main chassis 10, as indicated by the external leveling device, by adjusting the elevation of wheels 24 and 26 through jack assemblies 40 and 42. When a 360-degree rotation has been made the wheels 24 and 26 are now able to track in a level excavated path and the wheel elevations will no longer need to be adjusted. Hand crank 62 is turned to reposition the cutting head 54 and mounting assembly 12 along the longitudinal rails 14 and 16. At each subsequent position, as determined by the width of the cutter head, the main chassis 10 is pushed around in a circular direction for one 360-degree revolution until the entire work area has been excavated and leveled. Typically an entire circular work area is excavated, however half circles or other fractions of a 360-degree circular area can be excavated.

Figure 6:
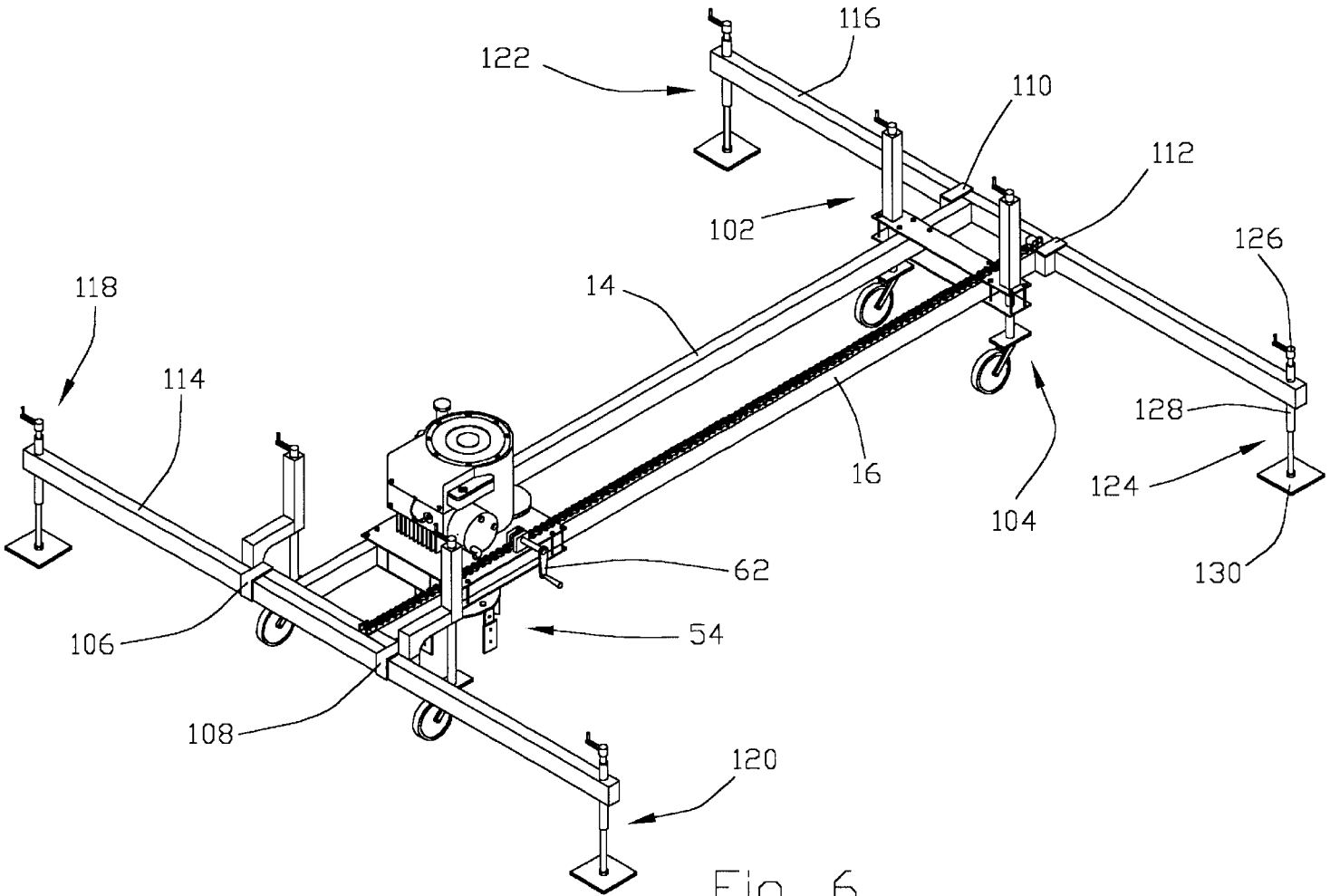
FIG. 6 is a perspective view of the earth-leveling excavator with alternative embodiments of the support and lateral positioning.

There are various possible embodiments with regard to supporting and positioning of the main chassis 10. FIG. 6 shows modifications that illustrate two of these possibilities. Wheel and jack assemblies 102 and 104 can replace the ground-engaging anchor for fully unrestrained lateral movement of the main chassis 10 for working in irregularly shaped areas.

All wheels can be removed or simply retracted and the main chassis 10 allowed to rest on two support rails 114 and 116. Support rails 114 and 116 allow linear movement of the main chassis 10 through brackets 106, 108, 110 and 112, which are attached to the main chassis 10. Jack assemblies 118, 120, 122 and 124 are attached to and support rails 114 and 116. Each of the four jack assemblies consists of a base plate 130, a hand crank 126 and a jack 128. With this embodiment of the invention, rectangular areas can easily be excavated to level grade by first leveling the support rails 114 and 116. This is accomplished by turning the hand cranks 126 attached to the jacks 128 in order to adjust the elevation of the rails 114 and 116 and consequently level the main chassis 10. As previously described, this task is performed with the aid of an external leveling device. By turning hand crank 62 the cutting head 54 is moved along in the direction of longitudinal rails 14 and 16, excavating a straight and level path. The main chassis 10 is then repositioned along the support rails 114 and 116 for subsequent passes.

The support rail embodiment mentioned above and illustrated in FIG. 6 is readily adaptable to excavating consistently sloping grades. This is accomplished by setting rails 114 and 116 to the desired slope prior to excavating. Alternatively the rails 114 and 116 can be set level but at differing elevations to accomplish the excavation of sloping grades.

The ground-engaging anchor embodiment of FIG. 1 can also be employed to excavate sloping grades by using an external leveling device to establish the desired slope while excavating the first circular path. The wheels will travel in this path for subsequent passes and the sloping grade will be maintained throughout the work area. By using differing elevations of the ground-engaging anchor 22 and the wheels 24 and 26, either concave or convex, conical shapes can also be excavated.

It will be appreciated that the apparatus provides an efficient and economical alternative to equipment currently available and processes currently in use. The above descriptions and specifications should not be construed as limitations on the scope of the invention, but as a detailed description of a preferred embodiment(s). Accordingly the scope of the invention is not limited by the sole embodiments illustrated, but encompasses any, and all embodiments within the scope of the following claims and their legal equivalents.

I claim:

1. An excavating apparatus for uniform planar surfacing of an area of earth comprising:

a powered rotary horizontal cutting blade assembly for cutting and dislodging earth;

an approximately vertical drive shaft operatively connected to said cutting blade assembly for transferring rotational power to said cutting blade assembly;

an approximately horizontal elongated longitudinal frame for support of said cutting blade assembly;

adjustable means for lateral positioning of said cutting blade assembly along the majority of the longitudinal axis of said frame;

ground engaging support means for said longitudinal frame;

means for movement of said support frame about an approximately horizontal plane; whereby said cutting blade assembly is progressively positioned to cut and dislodge earth, leaving a level or consistent sloping grade.

2. The excavating apparatus according to claim 1, wherein ground engaging support means further comprises a stationary ground engaging anchor pivotally connected to one end of said longitudinal frame and one or more ground engaging wheels on the opposite end of said longitudinal frame, whereby to allow rotation of said frame about said stationary ground engaging anchor within an approximately horizontal plane.

* * * * *